US009405256B2

(12) United States Patent
Numazu et al.

(10) Patent No.: US 9,405,256 B2
(45) Date of Patent: Aug. 2, 2016

(54) ROLL SHEET IMAGE FORMING APPARATUS

(71) Applicant: CASIO COMPUTER CO., LTD., Shibuya-ku, Tokyo (JP)

(72) Inventors: Toshihiko Numazu, Sayama (JP); Toshio Nagasaka, Iruma (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/807,659

(22) Filed: Jul. 23, 2015

(65) Prior Publication Data

US 2016/0041515 A1 Feb. 11, 2016

(30) Foreign Application Priority Data

Aug. 5, 2014 (JP) ..... 2014-159126

(51) Int. Cl.
*G03G 15/00* (2006.01)

(52) U.S. Cl.
CPC .... *G03G 15/652* (2013.01); *B65H 2301/41745* (2013.01); *B65H 2301/41829* (2013.01); *B65H 2402/441* (2013.01); *B65H 2402/442* (2013.01)

(58) Field of Classification Search
CPC ..... G03G 15/6517; G03G 15/652; G03G 15/6526; G03G 2215/00455; B65H 16/00; B65H 106/005; B65H 2301/41745; B65H 2301/41829; B65H 2301/419; B65H 2402/441; B65H 2402/442; B65H 2402/443; B65H 16/04; B65H 2301/4175; B65H 2405/422; B41J 15/00; B41J 15/02; B41J 15/08; B41J 11/58; B41J 15/20; B41J 15/22; B41J 29/06
See application file for complete search history.

(56) References Cited

U.S. PATENT DOCUMENTS

| | | | | |
|---|---|---|---|---|
| 5,078,825 | A | 1/1992 | Hirabayashi | |
| 6,722,238 | B2 * | 4/2004 | Shinga | B41J 11/663 399/385 |
| 2014/0064747 | A1 | 3/2014 | Numazu | |
| 2014/0099150 | A1 | 4/2014 | Matsumoto et al. | |

FOREIGN PATENT DOCUMENTS

| | | | |
|---|---|---|---|
| JP | 06008556 | A | 1/1994 |
| JP | 07039646 | Y2 | 9/1995 |
| JP | 07110716 | B2 | 11/1995 |
| JP | 3041682 | U | 9/1997 |
| JP | 10198096 | A | 7/1998 |
| JP | 2003034059 | A * | 2/2003 |

(Continued)

*Primary Examiner* — Justin Olamit
(74) *Attorney, Agent, or Firm* — Holtz, Holtz & Volek PC

(57) ABSTRACT

A roll sheet image forming apparatus includes an introduction opening and a guide plate. Instead of a continuous sheet held in an apparatus main body, a continuous sheet for option feeding provided at an outside is introduced into the apparatus main body through the introduction opening. The guide plate is for splicing a lead sheet and a continuous sheet. When feeding the continuous sheet, a feeding unit is pulled out from the apparatus main body, a lead sheet is set to be conveyable towards an image forming unit, the feeding unit is again accommodated in the apparatus main body, a front end of the continuous sheet is placed on the guide plate, a rear end of the lead sheet is placed on the guide plate through the introduction opening, the rear end and the front end are spliced by a bonding member and then the feeding unit operates.

17 Claims, 8 Drawing Sheets

(56) References Cited

FOREIGN PATENT DOCUMENTS

| | | | |
|---|---|---|---|
| JP | 2005179042 | A | 7/2005 |
| JP | 2005255298 | A | 9/2005 |
| JP | 2012000815 | A | 1/2012 |
| JP | 2014052433 | A | 3/2014 |
| JP | 2014088017 | A | 5/2014 |

* cited by examiner

ROLL SHEET IMAGE FORMING APPARATUS

CROSS-REFERENCE TO RELATED APPLICATION

This application claims priority based on Japanese Patent Application No. 2014-159126, filed on Aug. 5, 2014, the entire contents of which are incorporated by reference herein.

BACKGROUND OF THE INVENTION

1. Field of the Invention

The invention relates to a roll sheet image forming apparatus configured to feed and guide a continuous sheet wound in a roll shape even when the continuous sheet has a large roll diameter incapable of being accommodated in a preset mounting unit.

2. Description of the Related Art

In an image forming apparatus such as a printer, a copier, a facsimile and the like, an inkjet type configured to discharge ink to form an image on a medium to be printed and an electrophotographic type configured to form an image on a medium to be printed by using toner have been generally used. There is an image forming apparatus configured to selectively use both a cut sheet and a continuous sheet wound in a roll shape (hereinafter, also referred to as 'roll sheet'), as the medium to be printed.

For example, JP-A-H10-198096 discloses a copier 10 in which a roll sheet unit 70 configured to accommodate therein a roll sheet 72 is provided to be displaceable between a pulled-out state and an incorporated state, the roll sheet 72 accommodated in the roll sheet unit 70 is precut to a predetermined size by a cutter 100 provided in the roll sheet unit 70 and is fed to an image forming unit in the apparatus and an image is formed thereon.

The image forming apparatus configured to form an image is widely available in the market. Since the image forming apparatus available in the market is mass-produced, the cost thereof is decreasing.

For this reason, it may be possible to cost down a roll sheet image forming apparatus capable of forming an image on a roll sheet and the like by adopting a configuration of the image forming apparatus for the image forming unit configured to form an image on the roll sheet and the like.

For example, JP-A-2014-052433 suggests a label printer 1 in which a printer main body 10 is placed on a mount unit 82 having an unwinder 84 arranged therein, which is a roll sheet unwinding device, a roll sheet 200 is unwound by the unwinder 84, an image is formed thereon by an upper image forming unit (printer main body 10), the roll sheet is wound at one time by a rewinder 86, which is a winding device, and a large amount of labels or seals can be continuously printed.

In the meantime, for example, JP-A-2012-000815 discloses a configuration of, when a remaining amount of a continuous recording medium such as roll sheet is insufficient, splicing a new continuous recording medium to the continuous recording medium being used until then by a splicing tape and the like for a replacement operation of the continuous recording medium, and control of a splicing part.

However, when a roll sheet accommodation area is configured in the apparatus, such as the lower part of the printing unit, like the image forming apparatus using the roll sheet disclosed in JP-A-H10-198096 and JP-A-2014-052433, a maximum outer diameter of the useable roll sheet is physically determined depending on an apparatus main body. That is, since the entire apparatus is designed to normally reduce an equipment area and an overall height of the apparatus, the roll sheet accommodation space is naturally determined by a size of the apparatus main body. For example, in JP-A-H10-198096, a diameter of the roll sheet 72 corresponds to a size (height) of the roll sheet unit 70, and in JP-A-2014-052433, a diameter of the unwinder 84 corresponds to a size (height) of the mount unit 82.

However, a user may want to print (to feed a large capacity of continuous sheet) a roll sheet having a large diameter incapable of being accommodated in the apparatus. In this case, it is considered to configure a feeding unit (external feeding unit) of a roll sheet at an outside of the apparatus, to add an opening on a side surface of the apparatus and to guide a front end of the roll sheet to a sheet setting position. However, the structure is complicated and an operation thereof is troublesome. In particular, when an operation space in the vicinity of the sheet setting position is narrow or when the roll sheet is set and the front end of the sheet is manually guided to a predetermined position, the operation is difficult.

Regarding the above technical problems, JP-A-H10-198096 and JP-A-2014-052433 do not disclose favorable measures, i.e., do not suggest the configuration of feeding the continuous sheet from the outside and do not recognize the problems.

In the meantime, JP-A-2012-000815 discloses a technology of splicing the continuous recording media each other. However, as described above, when the operation space of the feeding guide unit is narrow, it is difficult to perform the splicing operation. Also, it does not disclose the configuration of feeding the continuous sheet from the outside.

SUMMARY OF THE INVENTION

It is therefore an object of the present invention to provide a roll sheet image forming apparatus capable of easily feeding and guiding a continuous sheet wound in a roll shape from an outside, even when the continuous sheet has a large roll diameter incapable of being accommodated in a preset mounting unit.

In order to achieve the above object, a roll sheet image forming apparatus of the present invention has following configurations.

A roll sheet image forming apparatus includes an image forming unit, a holding unit, a feeding unit and an introduction opening. The image forming unit forms an image on a sheet being conveyed. The holding unit holds a sheet wound into a roll shape. The feeding unit is pulled out in a predetermined direction from a storage chamber together with the holding unit and feeds the sheet held at the holding unit towards the image forming unit. The introduction opening is provided on a side surface of the storage chamber and introduces a sheet provided in an external feeding unit into the storage chamber.

Also, in order to achieve the above object, a roll sheet image forming apparatus of the present invention has following configurations.

A roll sheet image forming apparatus includes an image forming unit, a holding unit, a feeding unit and an introduction opening. The image forming unit forms an image on a sheet being conveyed. The holding unit holds a sheet wound into a roll shape. The feeding unit is pulled out in a predetermined direction from a storage chamber together with the holding unit and feeds the sheet held at the holding unit towards the image forming unit. The introduction opening is provided on a side surface of the storage chamber and guides a sheet from an outside of the storage chamber towards the feeding unit, instead of the sheet held at the holding unit.

Further, in order to achieve the above object, a roll sheet image forming apparatus of the present invention has following configurations.

A roll sheet image forming apparatus includes an image forming unit, a holding unit, a feeding unit, a storage chamber and an introduction opening. The image forming unit forms an image on a sheet being conveyed. The holding unit holds a sheet wound into a roll shape. The feeding unit feeds the sheet held at the holding unit towards the image forming unit. The storage chamber is provided below the image forming unit and accommodates the holding unit and the feeding unit to be pulled out in a predetermined direction. The introduction opening is provided on a side surface of the storage chamber and guides a sheet from an outside of the storage chamber towards the image forming unit via the feeding unit, instead of the sheet held at the holding unit.

DESCRIPTION OF THE PREFERRED EMBODIMENTS

Figure 1:
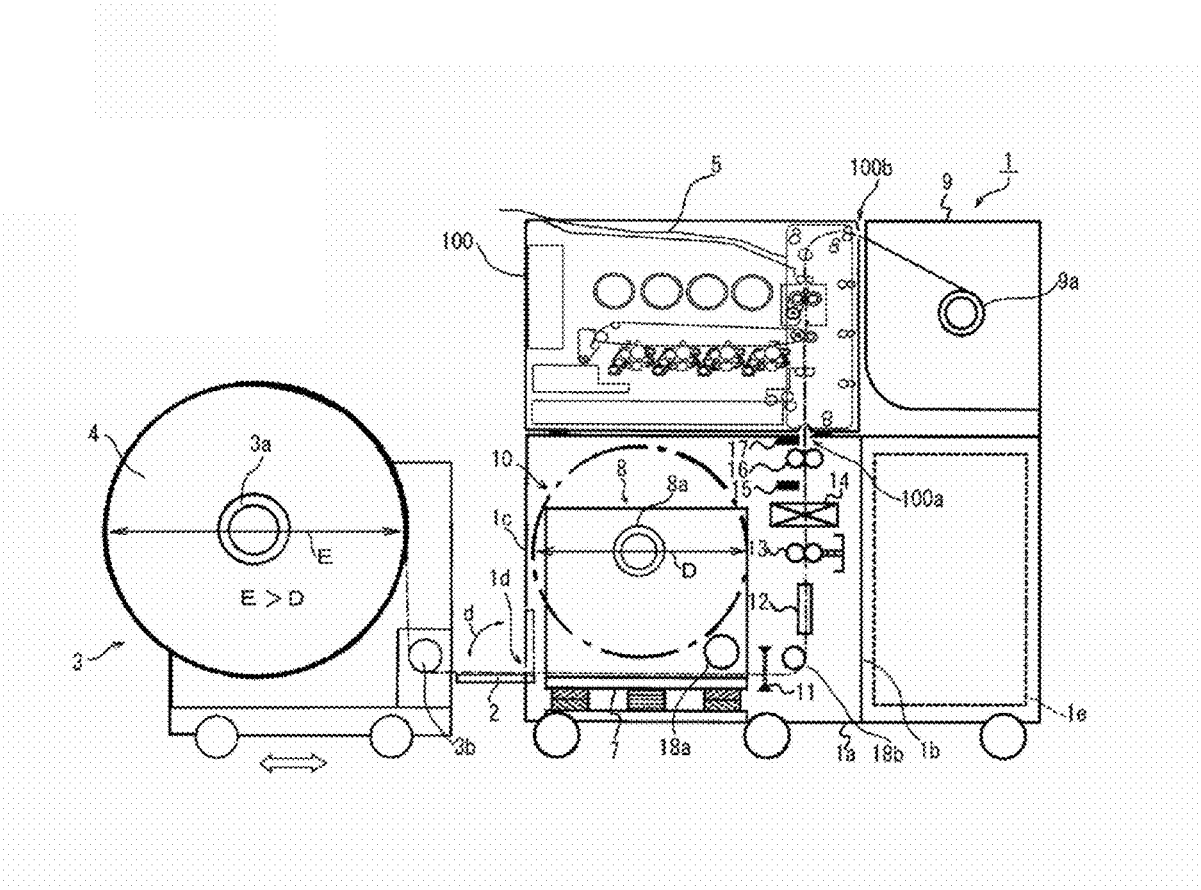
FIG. 1 is a system configuration view of a roll sheet image forming apparatus and an external feeding unit according to an illustrative embodiment of the present invention.

Hereinafter, illustrative embodiments of the present invention will be described in detail with reference to the accompanying drawings. Meanwhile, in below descriptions, the same elements are denoted with the same reference numerals.

An image forming unit (printer) to which a roll sheet image forming apparatus of the illustrative embodiment is applied will be first described and the roll sheet image forming apparatus, an external feeding unit and a feeding guide method of a continuous sheet for option feeding will be then described.

Image Forming Unit

Figure 5A:
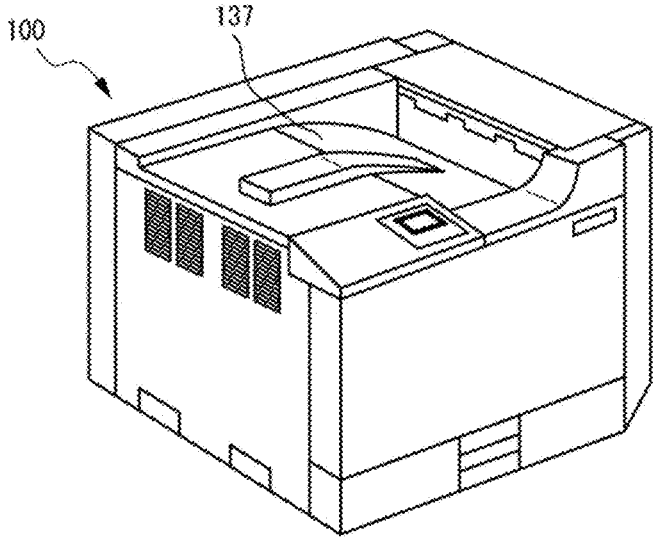
FIGS. 5A and 5B illustrate an image forming unit (printer) according to the illustrative embodiment of the present invention.
Figure 5B:
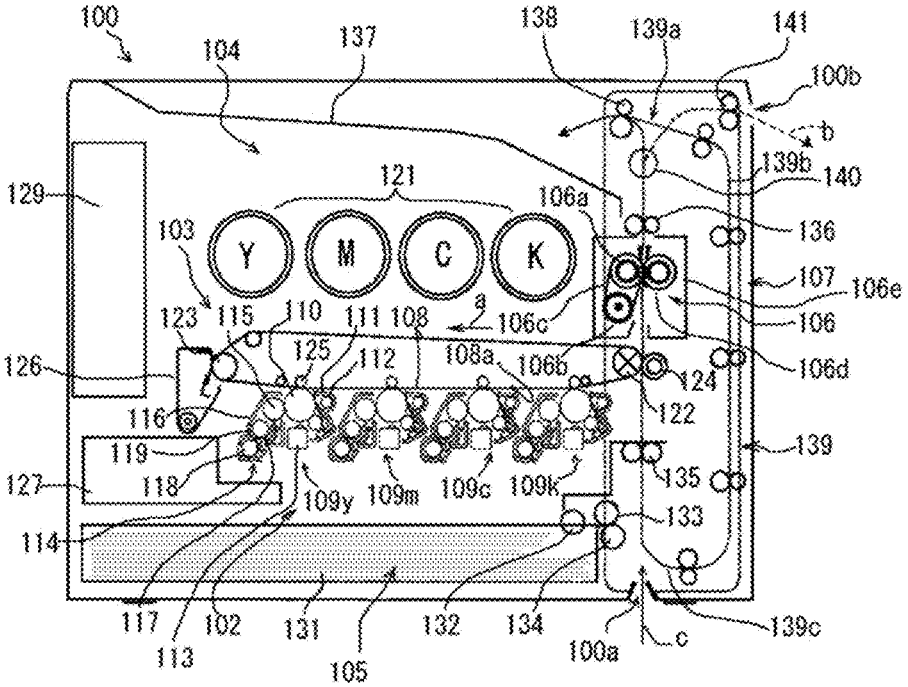

FIG. 5A is a perspective view illustrating an outward appearance of a printer 100, which is an image forming unit, and FIG. 5B is a sectional view illustrating an internal structure of the printer 100.

As shown in FIG. 5B, the printer 100 is a general tandem-type electrophotographic color printer of a secondary transfer type, and has an image forming main unit 102, a transfer belt unit 103, a toner supply unit 104, a feeding unit 105, a belt-type heat fixing unit 106, a conveyance unit 107 for duplex printing, and the like.

The image forming main unit 102 has four developing devices 109 (109*k*, 109*c*, 109*m*, 109*y*) arranged side by side in a multi stage form from right to left in FIG. 5B, which are in contact with a lower traveling surface 108*a* of a transfer belt 108 of the transfer belt unit 103. The image forming main unit 102 is held at a frame of the printer 100 so that it can be moved up and down between a position upon printing execution shown in FIG. 5B and a repair position lower than the position.

The three developing devices 109*c*, 109*m*, 109*y* of the four developing devices 109, which are positioned at a downstream side (left side in FIG. 5B), are configured to form a mono-color image by color toners of cyan (C), magenta (M) and yellow (Y), which are three subtractive primary colors, and the developing device 109*k* is configured to form a monochrome image by black toner (K), which is mainly used for a character, a black part of an image, and the like.

The respective developing devices 109 have the same configuration, except for colors of toners for image developing. Therefore, in the below, the corresponding configuration is described with reference to the developing device 109*y* for yellow (Y) toner.

The developing device 109 has a photosensitive drum 110 at the uppermost part. The photosensitive drum 110 has a circumferential surface made of an organic photoconductive material, for example. A cleaner 111, a charging roller 112, an optical writing head 113 and a developing roller 115 of a developing member 114 are arranged to contact the circumferential surface of the photosensitive drum 110 or to surround a vicinity thereof.

The developing member 114 has a housing 116 configured to cover an external part, a partition wall 117 provided therein, the developing roller 115, a first agitation conveying screw 118 and a second agitation conveying screw 119. Although not particularly shown, the first agitation conveying screw 118 and the second agitation conveying screw 119 have a screw shaft and a fin integrally formed with the screw shaft and configured to rotate, respectively.

To the developing member 114, any one toner of black (K), cyan (C), magenta (M) and yellow (Y) toners denoted with K, C, M, Y in FIG. 5B is supplied from a toner cartridge 121 of the toner supply unit 104 arranged above the transfer belt unit 103.

The transfer belt unit 103 has the endless transfer belt 108, which extends in a flat loop shape in a left-right direction of FIG. 5B at a substantial center of a main body apparatus, and a driving roller 122 and a driven roller 123, on which the transfer belt 108 is put and which are configured to circulate the transfer belt 108 in a counterclockwise direction denoted with an arrow 'a'.

A secondary transfer roller 124 is pressed against the driving roller 122 via the transfer belt 108, and forms a secondary transfer unit for secondarily transferring a primary transfer toner image on the transfer belt 108 to a sheet being conveyed thereto, which is a medium to be printed.

A first transfer roller 125 is integrally incorporated to the transfer belt 108. The first transfer roller 125 is arranged to face the photosensitive drum 110 with the transfer belt 108 being interposed therebetween.

The first transfer roller 125 is configured to directly transfer (primary transfer) a toner image to the lower traveling surface 108*a* of the transfer belt 108 circulating. The transfer belt 108 further conveys the toner image to the secondary transfer unit so as to transfer the toner image to the sheet (secondary transfer).

Also, a belt cleaner 126 is arranged at the transfer belt 108 so that it contacts a surface of the transfer belt put on the driven roller 123. A waste toner collection receptacle 127 configured to accommodate therein waste toner removed from the transfer belt 108 by the belt cleaner 126 is detachably arranged below the belt cleaner 126.

The toner supply unit 104 has four toner cartridges 121 arranged above an upper traveling surface of the transfer belt 108. Although not particularly shown, the toner supply unit 104 is held at the frame of the printer 100 so that it can be moved up and down between the position upon printing execution shown in FIG. 5B and a repair position higher than the position.

The four toner cartridges 121 of the toner supply unit 104 are configured to accommodate therein the black (K), cyan (C), magenta (M) and yellow (Y) toners, respectively.

The toner cartridges 121 can be attached and detached to and from the printer 100 by inserting and demounting the same in a front-side surface direction, i.e., a forward direction of a depth direction of the drawing sheet. Although not seen in a sectional view of FIG. 5B, the toner cartridges 121 are formed with toner discharge openings for supplying the toners to the developing devices 109.

When the toner cartridges 121 are mounted to the printer 100, the toner discharge openings communicate with a toner supply path extending upwards from the rear of the developing devices 109 and the toners are supplied to the developing devices 109 through the toner supply path. Although not seen in the sectional view of FIG. 5B, the toner supply path is arranged to go around at the rear of the transfer belt unit 103.

An electrical unit 129 is arranged at the left of the toner supply unit 104 from the left of the belt cleaner 126 to the upper part. The electrical unit 129 is mounted with a circuit board having a control device consisting of a plurality of electronic components mounted thereon.

The feeding unit 105 has one feeding cassette 131. A sheet pickup roller 132, a conveying roller 133, a separation roller 134 and a pair of standby conveying rollers 135 are arranged in the vicinity of a feeding opening (right in FIG. 5B) of the feeding cassette 131.

The second transfer unit is formed in a sheet conveying direction (vertically upward direction in FIG. 5B) of the standby conveying rollers 135. The belt-type heat fixing unit 106 is arranged downstream (upper in FIG. 5B) of the secondary transfer unit.

The belt-type heat fixing unit 106 has a fixing roller 106*a* and a heating roller 106*b* in a fixing frame 106*e*. The fixing belt 106*c* is put on the fixing roller 106*a* and the heating roller 106*b*. Also, a pressing roller 106*d* is pressed against the fixing roller 106*a* via the fixing belt 106*c*, so that a fixing nip portion is formed.

A pair of carrying-out rollers 136 configured to carry out the fixed sheet from the heat fixing unit 106 and a pair of sheet discharge rollers 138 configured to discharge the carried out sheet to a sheet discharge tray 137 formed on an upper surface of the apparatus are arranged further downstream of the belt-type heat fixing unit 106.

The conveyance unit 107 for duplex printing also serves as an opening/closing member of which an outer surface (right outer surface in FIG. 5B) opens outwards or closes an inside of the printer 100 from a side.

The conveyance unit 107 for duplex printing has a conveying path 139 having a conveying start path 139*a* branching from a portion just before the sheet discharge rollers 138 in a rightward lateral direction of FIG. 5B, a conveying intermediate path 139*b* bent downwards from the conveying start path 139*a* and a conveying end path 139*c* bent in a further leftward lateral direction and configured to reverse the sheet being conveyed.

Also, in the printer 100 of this illustrative embodiment, a switching device 140 configured to switch and guide a roll sheet 23 (which will be described later) to a guide conveying path shown with a dotted line b direction is arranged in a conveying path between the carrying-out rollers 136 and the sheet discharge rollers 138, and a pair of roll sheet discharge rollers 141 is arranged in a sheet discharge opening 100*b*.

Also, a feeding opening 100*a* configured to introduce the roll sheet 23 from a lower direction shown with an arrow c is formed at the lower part of the printer 100 at which the separation roller 134 and the conveying end path 139*c* are arranged.

In the printer 100, when forming an image on a normal sheet (for example, A4 sheet) such as a cut sheet, a normal sheet picked up from the feeding cassette 131 of the feeding unit 105 by the sheet pickup roller 132 is conveyed by the feeding roller 133 and the separation roller 134, and is sent to the secondary transfer unit by the standby conveying rollers 135, so that a toner image on the transfer belt 108 is secondarily transferred to the normal sheet by the secondary transfer unit having the driving roller 122, on which the transfer belt 108 is put, and the secondary transfer roller 124.

In the meantime, when a medium on which an image is to be formed is a roll sheet, for example, the roll sheet is fed from the feeding opening 100*a* provided on the bottom of the printer 100. The fed roll sheet is conveyed to the secondary transfer unit via the standby conveying rollers 135, so that the toner image on the transfer belt 108 is secondarily transferred to the roll sheet.

The normal sheet for which the secondary transfer has been made is conveyed to the belt-type heat fixing unit 106 positioned above the secondary transfer unit, in which the fixing processing of the toner image is then performed, and is then discharged to the sheet discharge tray 137 via the sheet discharge rollers 138. On the other hand, when the medium is the roll sheet, the roll sheet is conveyed to the belt-type heat fixing unit 106, in which the fixing processing of the toner image is then performed, and is then discharged in the dotted line b direction from the sheet discharge opening 100*b* via the switching device 140 and the roll sheet discharge rollers 141, as described above.

Therefore, the configuration of the printer 100 is basically the same as a general printer, and has the features that the switching device 140, the sheet discharge opening 100*b*, the roll sheet discharge rollers 141 and the feeding opening 100*a* formed at the lower part of the apparatus, through which the roll sheet can be fed, are provided.

Roll Sheet Image Forming Apparatus

In the below, a configuration of the roll sheet image forming apparatus is described in detail.

Figure 6A:
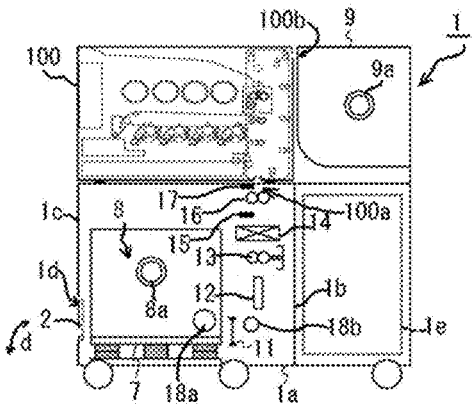
FIGS. 6A to 6C are front views of the roll sheet image forming apparatus according to the illustrative embodiment of the present invention.
Figure 6B:
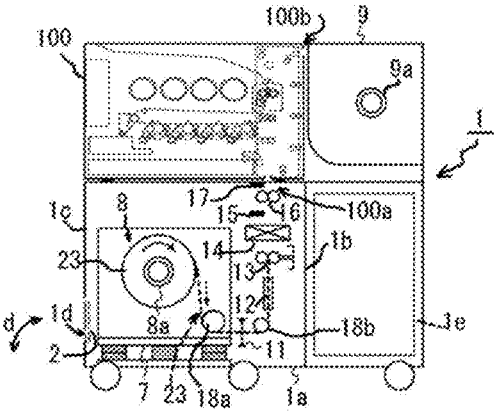
Figure 6C:
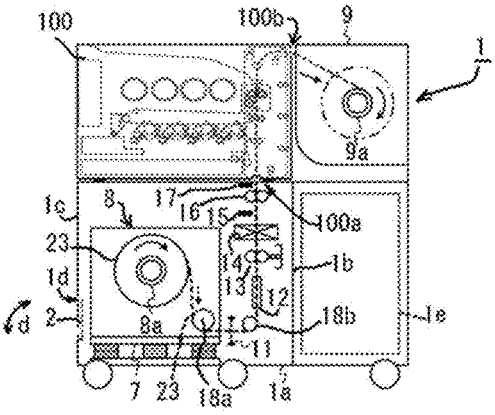

FIGS. 6A to 6C are front views of the roll sheet image forming apparatus according to the illustrative embodiment of the present invention. FIG. 6A illustrates a state where a prescribed roll sheet is not mounted yet, FIG. 6B illustrates a state where the prescribed roll sheet is set to be fed, and FIG. 6C illustrates a state where an image is being formed with the prescribed roll sheet being unwound and wound.

As shown in FIG. 6A, the roll sheet image forming apparatus 1 has a roll sheet feeding device 1*a*, the printer 100 arranged above the roll sheet feeding device 1*a*, and a winding device 9.

As shown in FIGS. 6B and 6C, the roll sheet feeding device 1*a* is configured to feed the roll sheet 23 to the printer 100. The printer 100 functions as an image forming unit configured to form a multi-color image on the roll sheet 23 by the toners of four YMCK (yellow (Y), magenta (M), cyan (C) and black (K)) colors on the basis of image data of a printing target.

The roll sheet feeding device 1*a* is configured to continuously unwind the roll sheet 23, which is wound into a roll shape around a predetermined winding core (sheet tube), and to convey the same to the image forming main unit 102 of the printer 100 along a predetermined conveying path. Specifically, the roll sheet feeding device 1*a* has a slide plate 7, a holding unit 8, a serpentine detection sensor 11, a side guide 12, a pair of conveying rollers 13, an auto cutter 14, a mark sensor 15, a pair of entrance rollers 16, an entrance sensor 17 and driven rollers 18*a*, 18*b*. Here, the conveying rollers 13, the entrance rollers 16, the driven rollers 18*a*, 18*b*, the side guide 12 and the like function as a feeding means.

Also, the holding unit 8 functions as a sheet holding means, and is configured to hold the roll sheet 23 before an image is formed by the printer 100. The holding unit 8 has a rotary shaft 8*a*, which is configured to penetrate the winding core positioned at a center of winding of the roll sheet 23 and to hold the roll sheet 23, and a support plate configured to support the rotary shaft, and is configured to rotatably hold the roll sheet 23.

The holding unit 8 is mounted with a motor (not shown) for rotating the rotary shaft 8*a*. The holding unit 8 functions as an unwinder configured to rotate the rotary shaft 8*a* with an instructed rotation number per unit time (the number of rotations per unit time) by the driving of the motor and to unwind the roll sheet 23 being held.

Also, a powder brake (not shown) is attached to the rotary shaft 8*a* of the holding unit 8. The powder brake is configured to brake the rotation of the rotary shaft 8*a* so that tension (tensile force) applied to the roll sheet 23 unwound and conveyed from the holding unit 8 is constant. By the function of the powder brake, the roll sheet 23 unwound from the holding unit 8 is stably conveyed without being loosened.

The slide plate 7 has slide bearings at both sides thereof, and is configured to slide the holding unit 8 in a direction of the rotary shaft 8*a* (a width direction of the roll sheet 23). When the serpentine detection sensor 11 detects serpentine movement of the roll sheet 23 being conveyed in the roll sheet feeding device 1*a*, the slide plate 7 is applied with a driving force from an actuator and moves the holding unit 8 in a direction of cancelling the detected serpentine movement.

The serpentine detection sensor 11 is configured to detect the serpentine movement of the roll sheet 23 being conveyed in the roll sheet feeding device 1*a*. Specifically, the serpentine detection sensor 11 has a plurality of sets light emitting elements and light receiving elements arranged to face each other so that end portions of the roll sheet 23 in a width direction are positioned therebetween. The serpentine detection sensor 11 is configured to determine whether the light emitted from the light emitting element is received by the light receiving element without being blocked, for each of the multiple sets, thereby measuring positional deviation of the end portions of the roll sheet 23 in the width direction without contacting the roll sheet 23.

The pair of conveying rollers 13 is configured to sandwich and convey the roll sheet 23 unwound from the holding unit 8 and conveyed via the driven rollers 18*a*, 18*b* and the side guide 12, thereby feeding the roll sheet to the pair of entrance rollers 16. The pair of entrance rollers 16 is configured to sandwich and convey the roll sheet 23 fed from the pair of conveying rollers 13, thereby feeding the same to the printer 100 through the feeding opening 100*a* of the printer 100.

The auto cutter 14 is configured to cut the roll sheet 23, as required. For example, when the roll sheet 23 of a length necessary for image formation in the printer 100 is completely conveyed, the auto cutter 14 cuts a longitudinal end (rear end) of the roll sheet 23. Also, the cutting operation of the auto cutter 14 is controlled by a control means (not shown) so as to cut a sheet 5 for lead from a continuous sheet 4 for option feeding.

The mark sensor 15 is configured to detect an original mark that is recorded on a surface of the roll sheet 23 and is used as a position reference for image formation by the printer 100.

The entrance sensor 17 is configured to detect a start end (front end) of the roll sheet 23 entering the feeding opening 100*a* of the printer 100 from the pair of entrance rollers 16. Specifically, the entrance sensor 17 has a light emitting element and a light receiving element, and determines that a start end of the roll sheet 23 is detected, when the light generated from the light emitting element is blocked by the start end of the roll sheet 23 and is not thus detected by the light receiving element. When the entrance sensor 17 detects the start end of the roll sheet 23, the printer 100 starts to drive a variety of the pairs of rollers and to convey the roll sheet 23 introduced therein.

In the meantime, as can be clearly seen from FIGS. 6A to 6C, the serpentine detection sensor 11, the driven roller 18*b*, the side guide 12, the pair of conveying rollers 13, the auto cutter 14, the mark sensor 15, the pair of entrance rollers 16, the entrance sensor 17 and the like form a substantially vertical conveying path.

An area shown with the dotted line at the right of the roll sheet feeding device 1*a* is partitioned by a partition wall 1*b* and is used as a storage chamber 1*e* of disposables such as the roll sheet, the toner and the like.

Therefore, in order to sandwich the front end of the roll sheet between the pair of conveying rollers 13 and to manually set the roll sheet to a feedable state, after attaching the roll sheet 23 to the rotary shaft 8*a* of the holding unit 8, as shown in FIG. 6B, from the state shown in FIG. 6A where the roll sheet 23 is not mounted yet, the partition wall 1*b* becomes an obstacle, so that an operation space is narrow and it is difficult to perform the operation.

Thus, according to the roll sheet image forming apparatus 1 of this illustrative embodiment, although described in detail later with reference to FIGS. 7A to 7C, the slide plate 7, the holding unit 8, the driven rollers 18*a*, 18*b*, the serpentine detection sensor 11, the side guide 12, the pair of conveying rollers 13, the auto cutter 14, the mark sensor 15, the pair of entrance rollers 16, the entrance sensor 17 and the like are configured to be integrally moveable with respect to a main body of the roll sheet feeding device 1*a*, i.e., configured to function as a drawable and receivable feeding unit, and the entire feeding unit is pulled out forwards and is thus set to the feedable state.

In the meantime, a main body side 1*c* of the roll sheet feeding device 1*a* is formed with an introduction opening 1*d* of a continuous sheet for option feeding (which will be described later). An openable guide plate 2 (refer to a two-headed arrow d) is provided in the vicinity of the introduction opening 1*d*. In FIGS. 6A to 6C, the guide plate 2 is closed along the main body side 1*c* of a left surface of the roll sheet feeding device 1*a*. However, as described later with reference to FIG. 1, the guide plate 2 is opened horizontally by 90° and serves as a feeding guide plate when handling a continuous sheet for option feeding.

In the meantime, the winding device 9 functions as a winding means (rewinder), and is configured to wind and hold the roll sheet 23 discharged from the printer 100 around a winding shaft 9*a*.

In the below, a method of mounting the roll sheet 23 having a preset size (diameter) to the holding unit 8 in the roll sheet image forming apparatus 1 and operating the apparatus is described.

Figure 7A:
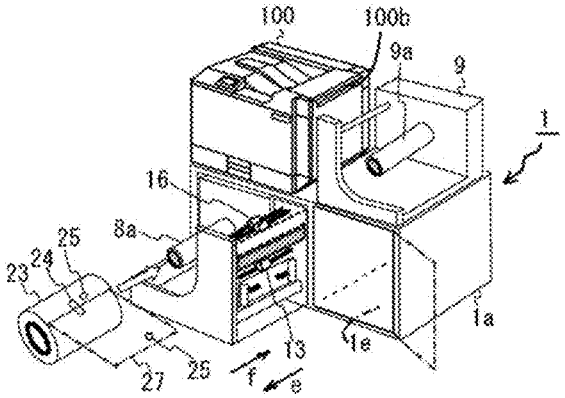
FIGS. 7A to 7C are perspective views of the roll sheet image forming apparatus according to the illustrative embodiment of the present invention.

As shown in FIG. 7A, before the printing, a user pulls out the entire feeding unit in an arrow e direction from the apparatus main body of the roll sheet feeding device 1*a* and mounts the roll sheet 23 before the printing of which a start end 27 is fixed by a fixing tape 24, for example, to the rotary shaft 8*a* of the holding unit 8 (refer to an outline arrow). Then, the user sandwiches the start end 27, from which the fixing tape 24 has been removed, between the pair of conveying rollers 13, as shown with the dotted line in FIG. 6B and returns the entire feeding unit to the original state (refer to an arrow f direction) to complete a preparation operation.

At this state, when a feeding request is received from the printer 100 having received print data from a host device (not shown), the rotary shaft 8*a* of the holding unit 8, the pair of conveying rollers 13, the pair of entrance rollers 16 and the like are driven to convey the roll sheet 23 to the printer 100.

Here, an original mark 25 is recorded in advance on the roll sheet 23. The original mark 25 functions as a first reference mark, which becomes a position reference when an image is formed on the roll sheet 23 by the printer 100. The original mark 25 recorded on the roll sheet 23 being conveyed is detected by the mark sensor 15.

The original mark 25 is recorded at a constant interval at a plurality of positions from the start end 27 to a termination 28 (refer to FIG. 7C) when the roll sheet 23 is configured by a label sheet. The interval is set to a length corresponding to a pitch of each label in the image data to be output so that the printer 100 can adjust a position of image formation for each label.

Figure 7B:
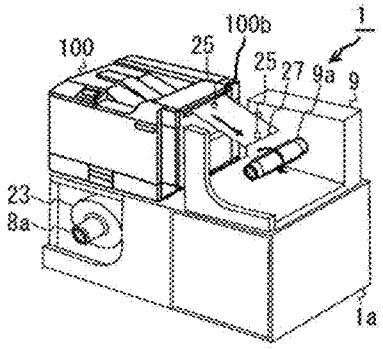
Figure 7C:
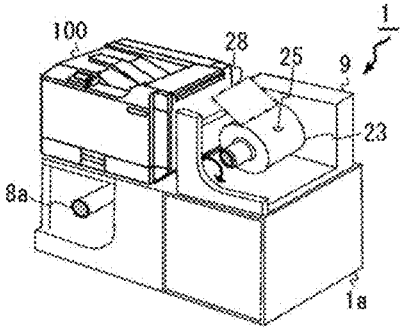

The roll sheet 23 conveyed to the printer 100 is formed thereon with a predetermined image and is then discharged from the sheet discharge opening 100*b* of the printer 100, as shown in FIG. 7B.

An overall operation of the winding device 9 is controlled by a control unit (not shown). For example, when the winding request of the roll sheet 23 is received from the printer 100, the winding shaft 9*a* is rotated to wind the roll sheet 23 being discharged to the printer 100, as shown with the dotted line in FIG. 6C.

When the winding is completed, the normal printing is also over. The termination 28 of the completely wound roll sheet 23 is temporarily fixed by the fixing tape 24 and is removed from the winding device 9.

In the roll sheet image forming apparatus 1, the roll sheet 23 to be mounted on the holding unit 8 has a preset size (diameter). That is, the size of the roll sheet is set to a size mountable to a size of the holding unit 8, in other words, a size (height, width) of the roll sheet feeding device 1*a*. In this illustrative embodiment, a size of about 350 mm is a storage limitation, and a roll sheet having a larger size cannot be printed.

As described above, some users may want to use a roll sheet having a size (diameter) that cannot be accommodated in the roll sheet feeding device 1*a*. Therefore, in an illustrative embodiment of the present invention, a configuration of option feeding considering the roll sheet having a large diameter (large capacity) is suggested.

That is, according to an illustrative embodiment of the present invention, a special configuration is added to the roll sheet image forming apparatus 1 so that the roll sheet having a large diameter incapable of being accommodated in the holding unit 8 of the roll sheet feeding device 1*a* can be used as a continuous sheet for option feeding through an external feeding unit 3, and a special feeding guide method is also adopted.

Feeding Guide Method of Continuous Sheet for Option Feeding

As described above, according to the roll sheet image forming apparatus 1 of the illustrative embodiment of the present invention, the roll sheet feeding device 1*a* has the right storage chamber 1*e* for disposables such as roll sheet and toner, which is partitioned by the partition wall 1*b*, and the left drawable and receivable feeding unit.

The user pulls out the entire feeding unit and sets the roll sheet 23 to a feedable state.

Here, the holding unit 8 configured to mount and hold the roll sheet 23 thereto has the rotary shaft 8*a* at a substantial center thereof. A maximum size (diameter) of the roll sheet 23 to be mounted thereto is about 350 mm (refer to D in FIG. 1), as described above. Therefore, a roll sheet having a larger size (diameter) cannot be accommodated in the roll sheet feeding device 1*a*.

In order to cope with this situation, according to the illustrative embodiment of the present invention, as shown in FIG. 1, a following configuration is provided on the assumption that the external feeding unit 3 is configured to be coupled to the roll sheet feeding device 1*a* (refer to a two-headed outline arrow).

That is, the external feeding unit 3 that is applied to the present invention has a support shaft 3*a* and a guide roller 3*b*, and is configured to feed a continuous sheet 4 for option feeding. A mountable size (diameter) E of the continuous sheet 4 for option feeding is set to be larger than the maximum size (diameter) D of the roll sheet 23.

In the meantime, although the description of the specific structure of the external feeding unit 3 is omitted, it has substantially the same configuration as the holding unit 8 of the roll sheet feeding device 1*a*. That is, the external feeding unit 3 functions, instead of the holding unit 8.

In the below, a feeding guide method of the continuous sheet for option feeding according to the present invention is described. As described above, according to the illustrative embodiment of the present invention, the introduction opening 1*d* is provided so that a continuous sheet can be introduced into the roll sheet feeding device 1*a* from the external feeding unit 3. However, even when the introduction opening 1*d* is just provided, it is not possible to feed the continuous sheet 4 for option feeding from the external feeding unit 3.

The reason is as follows: even though the external feeding unit 3 is fixedly arranged to be coupled to the introduction opening 1*d* and the continuous sheet 4 for option feeding is introduced into the roll sheet feeding device 1*a* through the introduction opening 1*d*, the operation space is narrow, as described above, so that it is not possible to manually sandwich a front end 4*a* of the continuous sheet 4 for option feeding between the pair of conveying rollers 13 and to manually set the same to a feedable state.

In contrast, like the case of the roll sheet 23 having the preset size (diameter) described with reference to FIG. 7A, it is considered to pull out the entire feeding unit in an arrow e direction from the apparatus main body of the roll sheet feeding device 1*a*, to arrange the external feeding unit 3 in correspondence to the pulled-out feeding unit and then to feedably set the continuous sheet 4 for option feeding at this state.

However, in this case, when returning the entire feeding unit to the original state (the arrow f direction) to complete the preparation operation, it is also required to move the heavy external feeding unit 3 in association with the movement of the feeding unit. Thereby, the apparatus is complicated and larger and positional deviation between the continuous sheet 4 for option feeding and the roll sheet feeding device 1*a* may be caused due to the movement of the external feeding unit 3. That is, the above consideration is not practical.

Therefore, in this illustrative embodiment, as shown in FIGS. 2A, 2B, 3A, 3B and 4A to 4D, a special configuration is provided. That is, a sheet 5 for lead is prepared and a feeding guide method as described below is adopted.

Figure 2A:
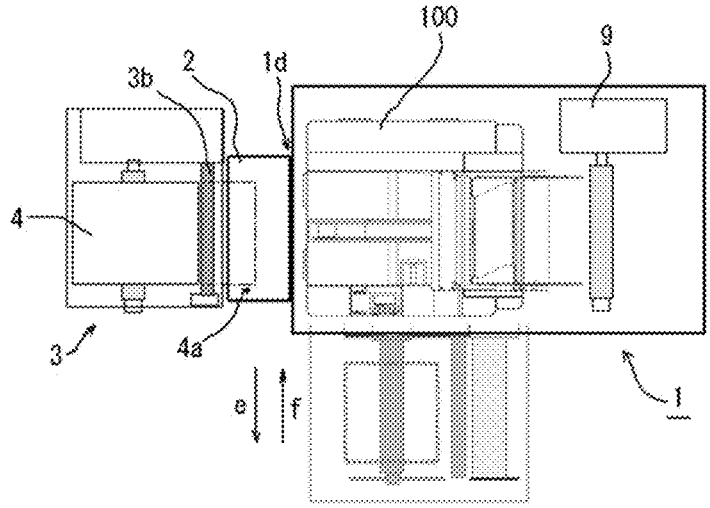
FIGS. 2A and 2B illustrate a feeding guide method according to the illustrative embodiment of the present invention (illustrates a state before a sheet for lead and a continuous sheet for option feeding are spliced).

First, when performing the feeding from the continuous sheet 4 for option feeding, the external feeding unit 3 is fixedly connected to the introduction opening 1*d* of the roll sheet feeding device 1*a* of which the guide plate 2 is opened, as shown in FIG. 2A. That is, it is premised that the external feeding unit 3 is arranged at a predetermined position together with the roll sheet image forming apparatus 1.

Then, the front end 4*a* of the continuous sheet 4 for option feeding is placed on the guide plate 2 and the entire feeding unit in which the roll sheet 23 is not mounted yet is pulled out (or when the roll sheet 23 is already mounted, the entire feeding unit is pulled out and the roll sheet 23 is removed).

Figure 2B:
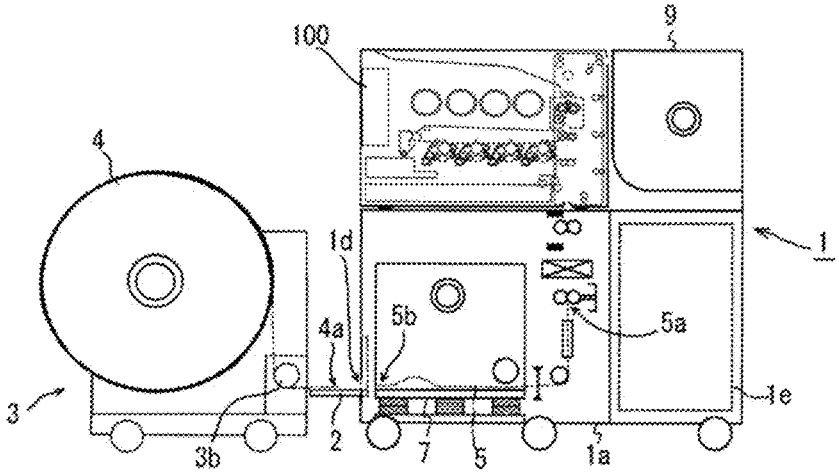

Subsequently, as shown in FIG. 2B, the sheet 5 for lead prepared in advance is placed on the slide plate 7, a front end 5*a* of the sheet 5 for lead is sandwiched between the pair of conveying rollers 13 and is thus set to a feedable state. Then, the entire feeding unit is returned to the original state (the entire feeding unit is accommodated). Here, a size of the sheet 5 for lead is set so that a rear end 5*b* of the sheet 5 for lead protrudes outwards from the introduction opening 1*d* by a predetermined length at a state where the front end 5*a* is set to be feedable, i.e., to be conveyable to the image forming unit by the feeding means.

Figure 3A:
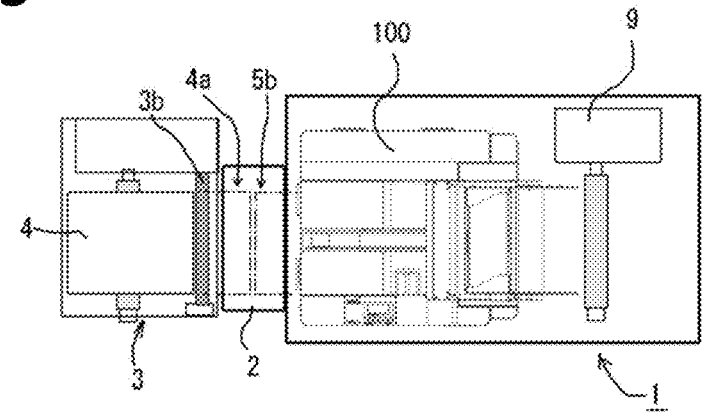
FIGS. 3A and 3B illustrate the feeding guide method according to the illustrative embodiment of the present invention (illustrates a state after the sheet for lead and the continuous sheet for option feeding are spliced).
Figure 3B:
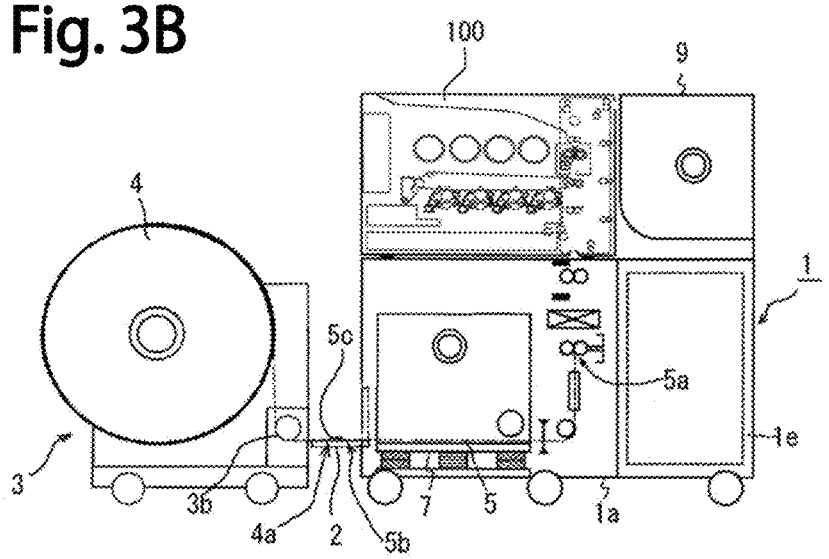

At this state, as shown in FIG. 3A, the rear end 5*b* of the sheet 5 for lead is pulled out onto the external guide plate 2 from the introduction opening 1*d*, and the front end 4*a* of the continuous sheet 4 for option feeding and the rear end 5*b* of the sheet 5 for lead are bonded using a bonding member 5*c* such as a splicing tape, as shown in FIG. 3B. In the meantime, regarding the bonding method, the rear end 5*b* of the sheet 5 for lead may be formed with an adhesive layer having a peeling member, the peeling member may be peeled off after pulling out the rear end 5*b* of the sheet 5 for lead onto the guide plate 2 and then the front end of the continuous sheet 4 for option feeding may be overlapped and bonded, instead of separately providing the bonding member 5*c*.

The continuous sheet 4 for option feeding bonded in this way is guided to the sheet 5 for lead, instead of the roll sheet 23 intended to normally use, and is guided to the printer 100 in the same manner as the roll sheet 23, and then an image is formed thereon.

The continuous sheet 4 for option feeding having an image formed thereon is wound onto the winding shaft 9*a* of the winding device 9. At this time, the continuous sheet 4 for option feeding may be wound including the preceding sheet 5 for lead. However, in this illustrative embodiment, as shown in FIG. 1, a slightly backward position of the spliced part of the sheet 5 for lead and the continuous sheet 4 for option feeding is cut by the auto cutter 14, and the switching device 140 of the printer 100 is controlled to switch the sheet discharge direction to the left side in FIG. 1, so that the cut preceding sheet 5 for lead is discharged onto the sheet discharge tray 137. In the meantime, the switching device 140 is controlled to switch the sheet discharge direction to the right side in FIG. 1 and only the continuous sheet 4 for option feeding from which the continuous sheet 4 for option feeding has been cut is wound around the winding shaft 9*a*.

In this way, the sheet 5 for lead can be used several times, so that it is possible to prevent the resource from being wasted.

Figure 4A:
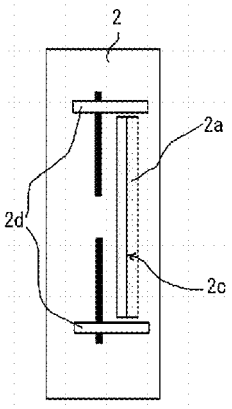
FIGS. 4A to 4D illustrate a guide plate according to the illustrative embodiment of the present invention and a relation between the sheet for lead and the sheet for option feeding.
Figure 4B:
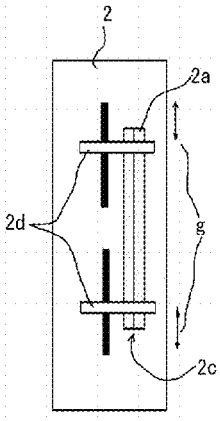

FIGS. 4A to 4D illustrate the guide plate according to the illustrative embodiment of the present invention and a relation between the sheet for lead and the sheet for option feeding. FIGS. 4A and 4B illustrate a state where the sheet 5 for lead and the continuous sheet 4 for option feeding are spliced. Here, in this illustrative embodiment, a rubber sheet 2*a*, for example, is bonded to the upper surface of the guide plate 2. The rubber sheet (a rubber lining is also possible) is made of a urethane-based rubber material, for example, and a surface thereof is slightly adhesive. Therefore, the rubber sheet can be easily detached even though it has the adhesiveness.

Also, a central line 2*c* is printed at a substantial center of the rubber sheet, so that it is possible to temporarily fix and position an end portion of a sheet in conformity to the central line (instead of the central line 2*c*, the rubber sheet may be formed to have a step and the positioning may be performed by butting an end portion of a sheet thereto). Further, the upper surface of the guide plate 2 is provided with width restraint guides 2*d*, 2*d* for aligning a width of a sheet. The width restraint guides are configured to move in conformity to a sheet width (refer to a two-headed arrow g in FIG. 4B).

Figure 4C:
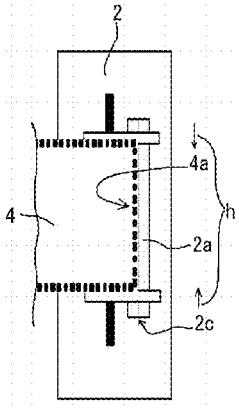
Figure 4D:
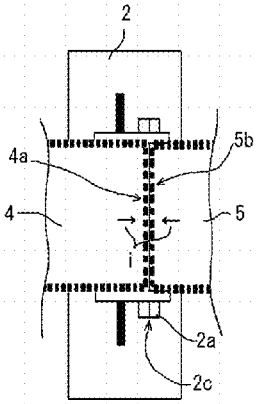

FIGS. 4C and 4D illustrate an operation of splicing the sheet 5 for lead and the continuous sheet 4 for option feeding on the guide plate 2. That is, as described above, the unwound continuous sheet 4 for option feeding is placed onto the guide plate 2 in conformity to the width restraint guides 2*d*, 2*d* moved in an arrow h direction, as shown in FIG. 4C, and then a front end portion thereof is temporarily fixed in conformity to the central line. On the other hand, the sheet 5 for lead is pulled out onto the guide plate 2, the rear end portion 5*b* thereof is temporarily fixed in conformity to the central line 2*c*, as shown in FIG. 4D, and then the front end portion and the rear end portion are bonded using the bonding member 5*c*.

The guide plate 2 is provided, so that it is possible to securely splice the sheet 5 for lead and the continuous sheet 4 for option feeding without the positional deviation and to secure the stability of the feeding conveying.

In the above illustrative embodiment, the continuous sheet 4 for option feeding is placed on the guide plate 2 and then the sheet 5 for lead is placed thereon. Then, both are bonded. However, the operation sequence may be changed so that the sheet 5 for lead is first placed on the guide plate 2 and then the continuous sheet 4 for option feeding is placed thereon. Also, in the illustrative embodiment of the present invention, the guide plate 2 is arranged on the main body side 1*c* of the roll sheet feeding device 1*a*. However, the guide plate 2 may be provided for the external feeding unit 3.

In the above descriptions, the sheet mounted on the external feeding unit 3 and wound in a roll shape has been exemplified as the continuous sheet 4 for option feeding. However, the present invention is not limited to the roll-shaped continuous sheet.

Figure 8:
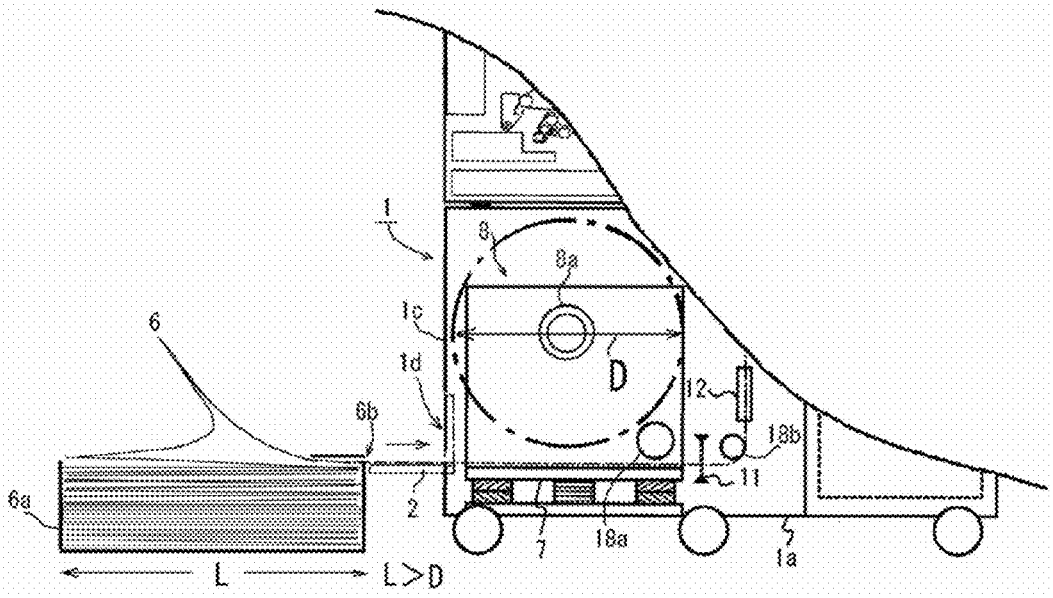
FIG. 8 is a partially cutaway system configuration view illustrating a roll sheet image forming apparatus according to another illustrative embodiment of the present invention and a configuration where a continuous sheet is used as the continuous sheet for option feeding.

FIG. 8 illustrates another illustrative embodiment of the present invention, in which a continuous sheet is used as the continuous sheet for option feeding.

As shown in FIG. 8, a continuous sheet 6 of this illustrative embodiment is loaded and accommodated with being folded in a receptacle 6*a*, like the external feeding unit 3, and can be pulled out from an opening 6*b*.

Here, the continuous sheet 6 of this illustrative embodiment has a folded size larger than the maximum size (diameter) D of the roll sheet 23 to be originally mountable to the roll sheet feeding device 1*a*, as seen from a feeding direction. Therefore, it is not possible to feed the continuous sheet 6 with being loaded on the slide plate 7, as it is.

Therefore, although the specific descriptions are omitted, the continuous sheet 6 can also be fed via the pulling out operation of the feeding unit and the sheet 5 for lead, like the above illustrative embodiment.

As described above, according to the present invention, it is not necessary to provide a mechanism for moving the heavy external feeding unit 3 in association with the movement of the feeding unit. The continuous sheet for option feeding is fixed on the guide plate 2 in the vicinity of the introduction opening 1*d*, so that it can be easily fed and guided. Therefore, the positional deviation between the continuous sheet 4 for option feeding and the roll sheet feeding device 1*a* is not caused. As a result, the present invention can be effectively applied to a roll sheet having a large size and a long continuous sheet, which cannot be accommodated in the preset mounting unit.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

What is claimed is:

1. A roll sheet image forming apparatus comprising:

an image forming unit that is configured to form an image on a sheet being conveyed;

a holding unit that is configured to hold a sheet wound into a roll shape;

a feeding unit that is configured to be pulled out in a predetermined direction from a storage chamber together with the holding unit and that is configured to feed the sheet held at the holding unit towards the image forming unit;

an introduction opening that is provided on a side surface of the storage chamber and that is configured to introduce a sheet provided in an external feeding unit into the storage chamber; and a cover part that is configured to open and close the introduction opening, wherein the cover part functions as a guide plate to guide the sheet provided in the external feeding unit into the storage chamber, when the introduction opening is opened.

2. The roll sheet image forming apparatus according to claim 1, wherein the cover part is configured to fall down towards an outside of the storage chamber, thereby opening the introduction opening.

3. A roll sheet image forming apparatus comprising:

an image forming unit that is configured to form an image on a sheet being conveyed;

a holding unit that is configured to hold a sheet wound into a roll shape;

a feeding unit that is configured to be pulled out in a predetermined direction from a storage chamber together with the holding unit and that is configured to feed the sheet held at the holding unit towards the image forming unit; and an introduction opening that is provided on a side surface of the storage chamber and that is configured to introduce a sheet provided in an external feeding unit into the storage chamber;

wherein the introduction opening is provided at a position where the introduction opening faces the feeding unit via the holding unit.

4. The roll sheet image forming apparatus according to claim 1, wherein the feeding unit is configured to feed the sheet introduced into the storage chamber through the introduction opening towards the image forming unit.

5. The roll sheet image forming apparatus according to claim 1, wherein the sheet introduced into the storage chamber through the introduction opening is conveyed horizontally below the holding unit and is then conveyed in a vertical direction by the feeding unit.

6. The roll sheet image forming apparatus according to claim 1, wherein the storage chamber includes:

a first side; and a second side which is perpendicular to the first side, and wherein the introduction opening is provided on the first side, and the holding unit or feeding unit is pulled out from the second side of the storage chamber.

7. The roll sheet image forming apparatus according to claim 1, wherein the storage chamber is provided below the image forming unit.

8. A roll sheet image forming apparatus comprising:

an image forming unit that is configured to form an image on a sheet being conveyed;

a holding unit that is configured to hold a sheet wound into a roll shape;

a feeding unit that is configured to be pulled out in a predetermined direction from a storage chamber together with the holding unit and that is configured to feed the sheet held at the holding unit towards the image forming unit;

an introduction opening that is provided on a side surface of the storage chamber and that is configured to guide a sheet from an outside of the storage chamber towards the feeding unit, instead of the sheet held at the holding unit; and a cover part that is configured to open and close the introduction opening, wherein the cover part functions as a guide plate to guide the sheet from the outside of the storage chamber into the storage chamber, when the introduction opening is opened.

9. The roll sheet image forming apparatus according to claim 8, wherein the cover part is configured to fall down towards the outside of the storage chamber, thereby opening the introduction opening.

10. The roll sheet image forming apparatus according to claim 8, wherein the introduction opening is provided at a position where the introduction opening faces the feeding unit via the holding unit.

11. The roll sheet image forming apparatus according to claim 8, wherein the sheet introduced into the storage chamber through the introduction opening is conveyed horizontally below the holding unit and is then conveyed in a vertical direction by the feeding unit.

12. The roll sheet image forming apparatus according to claim 8, wherein the storage chamber includes:

a first side; and a second side which is perpendicular to the first side, and wherein the introduction opening is provided on the first side, and the holding unit or feeding unit is pulled out from the second side of the storage chamber.

13. A roll sheet image forming apparatus comprising:

an image forming unit that is configured to form an image on a sheet being conveyed;

a holding unit that is configured to hold a sheet wound into a roll shape;

a feeding unit that is configured to feed the sheet held at the holding unit towards the image forming unit;

a storage chamber that is provided below the image forming unit and that is configured to accommodate the holding unit and the feeding unit to be pulled out in a predetermined direction;

an introduction opening that is provided on a side surface of the storage chamber and that is configured to guide a sheet from an outside of the storage chamber towards the image forming unit via the feeding unit, instead of the sheet held at the holding unit; and a cover part that is configured to open and close the introduction opening, wherein the cover part functions as a guide plate to guide the sheet from the outside of the storage chamber into the storage chamber, when the introduction opening is opened.

14. The roll sheet image forming apparatus according to claim 13, wherein the cover part is configured to fall down towards the outside of the storage chamber, thereby opening the introduction opening.

15. The roll sheet image forming apparatus according to claim 13, wherein the introduction opening is provided at a position where the introduction opening faces the feeding unit via the holding unit.

16. The roll sheet image forming apparatus according to claim 13, wherein the sheet introduced into the storage chamber through the introduction opening is conveyed horizontally below the holding unit and is then conveyed in a vertical direction by the feeding unit.

17. The roll sheet image forming apparatus according to claim 13, wherein the introduction opening is provided such that, when another sheet provided in an external feeding unit is guided into the storage chamber, said another sheet avoids interfering with the sheet held at the holding unit.

* * * * *